United States Patent [19]

Kajita

[11] 4,285,220

[45] Aug. 25, 1981

[54] MAGNETICALLY OPERABLE LOCK

[76] Inventor: Tomomasa Kajita, 2-3-18, Mariuyamadori, Abeno-ku, Osaka-shi, Japan

[21] Appl. No.: 959,598

[22] Filed: Nov. 13, 1978

[30] Foreign Application Priority Data

Dec. 29, 1977 [JP] Japan ..... 52-178382[U]

[51] Int. Cl.[3] ..... E05B 47/00

[52] U.S. Cl. ..... 70/276; 70/360; 70/413

[58] Field of Search ..... 70/276, 413, 360

[56] References Cited

U.S. PATENT DOCUMENTS

| | | | |
|---|---|---|---|
| 1,855,697 | 4/1932 | Sullivan | 70/223 |
| 3,421,348 | 1/1969 | Hallmann | 70/276 |
| 3,566,637 | 3/1971 | Hallmann | 70/276 |
| 3,584,484 | 6/1971 | Hallmann et al. | 70/413 X |
| 3,602,020 | 8/1971 | Kajita | 70/276 |
| 3,782,147 | 1/1974 | Hallmann | 70/276 |
| 3,967,479 | 7/1976 | Vick | 70/276 |
| 3,974,669 | 8/1976 | Stackhouse | 70/276 |

FOREIGN PATENT DOCUMENTS

| | | | |
|---|---|---|---|
| 2330014 | 1/1975 | Fed. Rep. of Germany | 70/413 |

*Primary Examiner*—Roy D. Frazier
*Assistant Examiner*—Carl F. Pietruszka
*Attorney, Agent, or Firm*—McGlew and Tuttle

[57] ABSTRACT

A magnetically operable key comprises a cylindrical casing containing a turnable member, a drive member and a latch, which are all co-rotatably mounted in the casing with the drive member axially displaceable between the turnable member and the latch within the casing. The drive member has a groove defined thereon which has two circumferential portions and a slanted portion interconnecting the circumferential portions. An engagement pin is connected to the casing and extends into the guide groove for causing axial movement of the drive member when the drive member is rotated and when the pin is disposed in the slanted portion. At least one magnetic piece is pivotally mounted to the turnable member and movable by a magnetic key from a misaligned position to an aligned position. The drive member has a cavity for receiving the magnetic piece when aligned to permit axial movement of the drive member. The misaligned magnetic piece abuts against the drive member and prevents axial movement thereof. In this position, the engagement pin rides within one of the circumferential grooves closest to the turnable member. This permits only limited rotation of the drive member. The engagement pin is prevented from entering the slanted groove portion by the engagement of the magnetic piece.

6 Claims, 6 Drawing Figures

MAGNETICALLY OPERABLE LOCK

FIELD AND BACKGROUND OF THE INVENTION

This invention relates in general to the construction of locks and, in particular, to a new and useful magnetically operable lock having a latch driving member which is blocked or released by magnetic pivotable pieces to lock or release the free movement of a latch member in a locking cylinder.

DESCRIPTION OF THE PRIOR ART

At the present time, many types of locks are known which may be operated by magnets which act to deflect magnet elements to permit a movable latching member to be displaced. The disadvantage of the known mechanisms is that they are easily tampered with and may be opened without much difficulty. In addition, it is difficult to manufacture such locks so that they will have a variety of magnetic combinations. A further disadvantage is that when the lock is tampered with, there is a tendency for the tamperer to destroy the lock completely so that it is no longer useful in any way.

SUMMARY OF THE INVENTION

In accordance with the present invention, a magnetic lock is provided which includes a turntable member containing pivotal magnetic pieces which may be selectively aligned so that the magnetic pieces will fit into receiving cavities of a drive member when they are moved by a key having a specific magnetic configuration. The drive member, which drives a locking latch member, is kept from turning beyond a certain point when the pivotal magnetic pieces are not aligned. In the construction of the invention, the turnable member may rotate with the drive member and the latch member through only a small arc when the key is not used because the drive member is guided by an engaging pin which engages into one portion of a bifurcated groove which has spaced parallel portions and a connecting oblique portion in the drive member. Because of a spring positioned between the drive member and the latch, the drive member is held away from the latch and against the misaligned magnetic pieces when the engaging pin starts to leave the one portion of the groove. Rotation of the drive member is thus limited. When a suitable key is engaged with the turnable member, however, the magnetic pieces may interengage with the drive member to permit it to be rotated further in respect to its engaging pin, so the latch can be turned further for easy opening and closing movement as desired.

An object of the invention is to provide a magnetically operable lock which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1A:
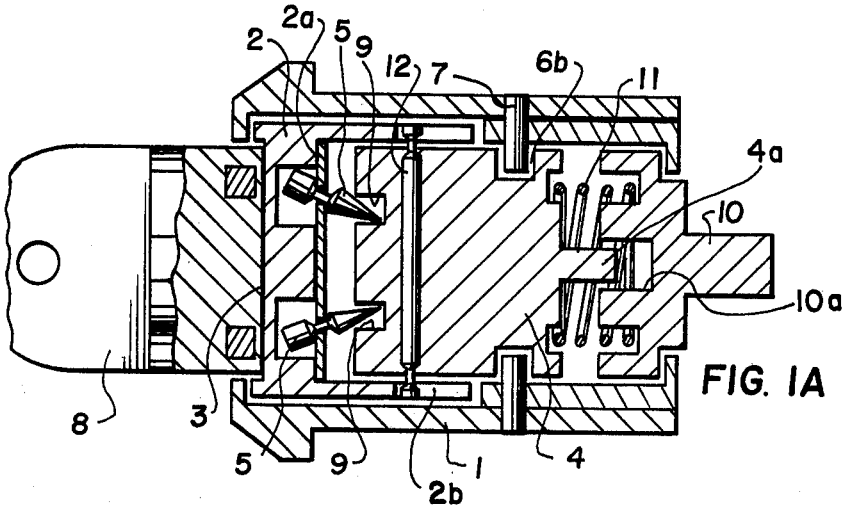
FIG. 1A is an axial sectional view of a magnetic lock constructed in accordance with the invention.

Referring to the drawings in particular, the invention embodied therein, comprises, a magnetically operable lock which includes a cylindrical case or housing 1 having an open inner end and an open outer end and with a latch member 10 rotatably mounted in the case adjacent the outer end and with a turnable member 2 rotatably mounted within the case adjacent the open inner end. A cylindrical drive member 4 is rotatably and axially movable in the case and has a cylindrical sidewall in slidable engagement with the case. The drive member is movable under the control of guide means defined between the drive member and the casing which, in the embodiment shown, includes a pin member or engaging pin 7 carried by the case or casing which is engageable in a guide groove 6 defined around the periphery of the drive member 4.

A spring means in the form of a coil spring 11 is disposed between the drive member 4 and the latch 10 and biases these two parts away from each other and it permits the driving interengagement of the co-rotative member 4 with the latch 10 to rotate it. The interengagement is through a tongue **4*a* which extends into a groove 10*a* of latch 10**.

The drawings show a hollow cylindrical casing 1, provided in its inner end with the turnable member 2 fitting therein and having a contact front face 3. The solid cylindrical drive member 4 is fitted alongside the turnable member 2 and is connected thereto for rotative movement. Drive member 4 is movable toward the turnable member 2 as limited by magnetic pivotable pieces 5 which are pivotally mounted intermediate their lengths at spaced locations on a plate portion **2*a* fixed to the turnable member 2**.

Figure 3A:
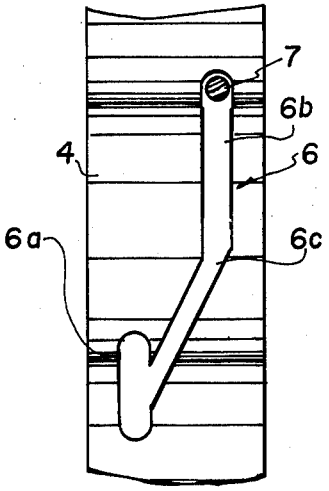
FIG. 3A is a partial developmental view of the periphery of the drive member showing the control slots.
Figure 3B:
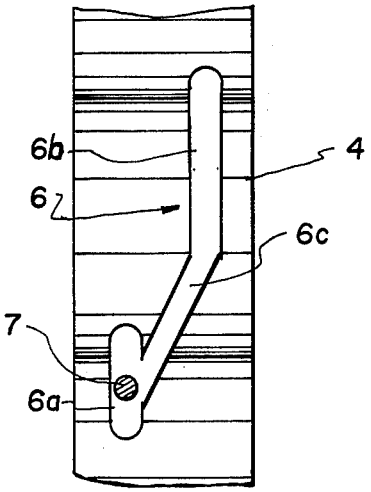
FIG. 3B is a view similar to FIG. 3A showing the operating pin in a different position.

As shown in FIGS. 3A and 3B, the member 4 is formed in its outer periphery with a circumferential channel, generally designated 6, including two parallel straight groove-portions **6*a* and 6*b* spaced apart axially by a given distance and in communication with each other through a slanting or oblique groove 6*c*. The engaging pin 7, projecting from the inner periphery of the cylindrical case 1, is in engagement with the circumferential channel 6. The magnetic pivotable pieces 5 are supported on the rear side of the turnable member 2**.

Figure 1B:
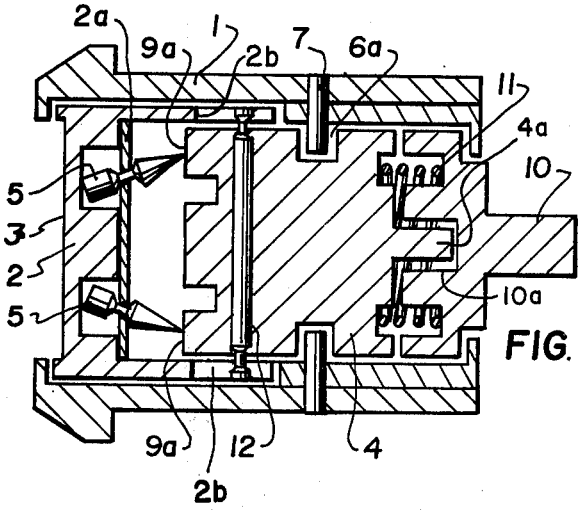
FIG. 1B is a view similar to FIG. 1A showing the parts in a non-actuated or locked position with the key removed.

When a specified magnet key 8 is fit into the contact face 3, the pivotable pieces 5 will move in a direction to engage in respective cavities 9 of the drive member 4, if a clearance is provided between drive member 4 and member 2, while, when the magnet key 8 is removed from the contact face 3, the pieces 5 may return into abutting contact with the peripheral edges **9*a* alongside the cavities 9, as shown in FIG. 1B. The clearance between members 2 and 4 which is needed to permit pieces 5 to pivot freely is provided since pin 7, when in groove 6***a*, holds members 2 and 4 apart.

It is, of course, desirable to provide a plurality of pivotable pieces 5 arranged in selected circumferential and radial locations to add to the safety of the lock and to provide a multiplicity of key combinations to actuate them.

Figure 2A:
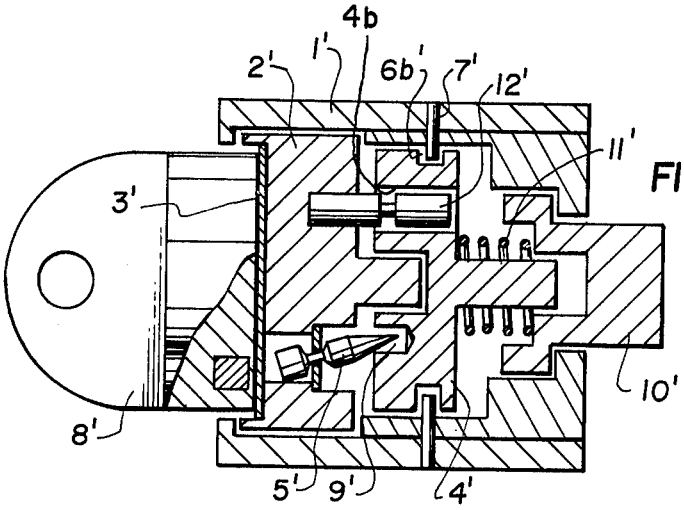
FIG. 2A is a view similar to FIG. 1A of another embodiment of the invention.

A turnable latch lever 10 in co-rotative engagement with the solid cylindrical drive member 4 through tongue 4*a* and groove 10*a* and with a spring 11 provided therebetween, is supported by the rear end of the casing 1. The drive member 4 is movable axially toward or away from the latch lever 10. A pin 12, for connecting the drive member 4 to a rear portion of the turnable member 2 for rotation, but permitting relative axial movement therebetween, extends diametrically of the drive member 4 into axially extending cross-grooves 2*b* of member 2, as seen in FIGS. 1A and 1B. Alternatively, a pin 12′ is disposed parallel to the axis of the drive member 4′ and movable into an opening 4*b*, as shown in the embodiment of FIGS. 2A and 2B and still permits relative axial movement between parts 2′ and 4′.

The magnet key 8, when fit into the contact face 3, moves the pivotable pieces 5 in a direction to engage the pieces into the cavities 9. If the pieces 5 abut edges 9*a* of drive member 4, the key is turned slightly to move pin 7 well into groove part 6*a*, which established the needed clearance for pieces 5 to move. When the magnet key 8 in this position is turned into an unlocking direction, the drive member 4 rotates with the turnable member 2 under the action of the spring 11 biasing the drive member 4 toward the member 2, thereby, altering the position of the circumferential channel or groove of drive member 4, relative to the engaging pin 7. When the engaging pin 7 comes into engagement with the slanting groove 6*c*, the drive member 4 (4′) moves toward the turnable member 2 (2′), as shown in FIGS. 1A, or in FIGS. 2A. Subsequently, the engaging pin 7 engages in the straight groove 6*b* positioned close to the latch lever 10. This free motion of drive member 4 provides sufficient rotation to turn latch 10 to an unlocking position.

Figure 2B:
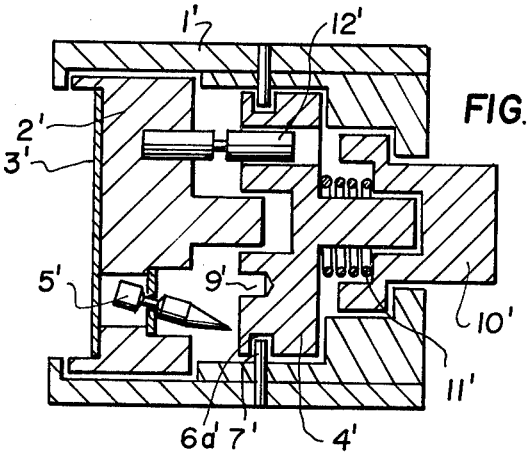
FIG. 2B is a view similar to FIG. 1B of the embodiment shown in FIG. 2A.

When the magnet key 8 is turned in an opposite direction, the engaging pin 7 comes into engagement with the straight groove 6*a* positioned close to the turnable member 2 while the drive member 4 moves toward the latch lever 10, as shown in FIG. 1B or FIG. 2B.

When the magnet key 8 is then removed from the contact face 3, the magnetic pivotable pieces 5 move out of alignment with the cavities 9 to prevent the movement of the drive member 4 toward the turnable member 2. The pin 7 engaging in the straight groove 6*a* near the member 2 holds the lock in its locked position and permits only a small rotation of drive member 4.

If the turnable member 2 should be turned by a magnet key other than the specified one, or by a screwdriver or the like, when the lock is in its locked state, the latch lever 10 will not turn enough toward the unlocking direction to unlock the lock, since the drive member 4 is positioned away from the turnable member 2 with the pin 7 engaging in the straight groove 6*a* positioned close to the member 2. If members 2 and 4 are turned so that pin 7 is positioned over the end of groove 6*c*, member 4 will move very slightly toward member 2 due to spring 11. This movement will be stopped however, by pieces 5 which jam against the surface 9*a* of member 4. Pieces 5 are released when pin 7 is moved into groove 6*a* proper by further rotation of members 2 and 4.

While specific embodiments of the invention have been shown and described in detail to illustrate the application of the principles of the invention, it will be understood that the invention may be embodied otherwise without departing from such principles.

What is claimed is:

1. A magnetically operable lock, comprising a hollow cylindrical case, a turnable member which fits into one end of said case and having a contact outer face and an inner face, a plurality of magnetic pivotable pieces supported on said inner face of said turnable member, a solid cylindrical drive member rotatably positioned in said case adjacent said turnable member movable toward or away from said turnable member and rotatable with said turnable member, said drive member being formed in its outer periphery with a circumferential channel including two axially spaced parallel straight grooves each having a limited circumferential extent and a slanting groove interconnecting said straight grooves and having a face disposed adjacent said pivotable pieces with engagement cavities for engagement with said pieces, an engaging pin extending from the inner periphery of said case into engagement with said circumferential channel, a turnable latch lever rotatably mounted in the other end of said case, a spring between said latch and said drive member and in engagement with said drive member, said drive member being co-rotative with and axially movable toward and away from said latch lever, and a magnetic key engageable with said contact face to pivot said pivotal pieces and being rotatable in one direction to rotate said turnable member, whereby, said drive member moves toward said turnable member with said engaging pin coming into engagement with the slanting groove by virtue of the pushing action of said spring and engagement of said pivotable pieces into said drive member cavities, rendering the latch lever further turnable upon the engaging pin coming into engagement with the straight groove positioned closer to the latch lever, the pivotable pieces being returnable out of engagement with the drive member cavities to hold the drive member away from the turnable member with the engaging pin being engaged in the straight groove positioned closer to the turnable member to render the latch lever turnable only to the extent that travel of said engaging pin in said straight groove closer to said turnable member permits, when the magnet key is removed from the contact face and when the drive member has been moved away from the turnable member by turning the magnet key and drive member in an opposite direction.

2. A magnetically operable lock comprising a cylindrical casing having an open inner end and an opposite open outer end, a latch member rotatably mounted in said casing adjacent said outer end, a cylindrical drive member rotatively mounted and axially movable in said casing having a cylindrical sidewall in slidable engagement with said case, guide means defined between said drive member and said case for controlling the axial and rotational movement of said drive member relative to said latch member and including a guide groove of limited circumferential extent defined on one of said drive member and said case and a pin carried by the other of said drive member and said case engaged in said guide groove, spring means disposed between said drive member and said latch biasing said drive member and said latch apart, said latch member being rotatable with said drive member, a turnable member rotatably mounted in said casing adjacent said open inner end, connecting means interconnecting said turnable member and said drive member for rotation together but permitting relative axial displaceable movement therebetween, at least one pivotal piece carried on said turnable member and having an actuation position in which said pivotal piece is directed toward said drive member, said drive member having an end face facing said pivotal piece with a receiving cavity thereon into which said pivotal piece extends in the actuation position, said pivotal piece disposable in abutting relationship with said end face when said pivotal piece is in a non-actuated position to block axial motion of said drive member, magnetic key means engageable with said turnable member and being rotatable therewith and housing a magnet for attracting said pivotal piece into the actuated position in said pivotal piece receiving cavity on said end face of said drive member, rotation of said drive member with said turning member being effective to move said drive member axially by the action of said guide groove and pin in a direction toward said latch, to further rotate said latch upon subsequent turning movement of said key, rotation of said latch being limited by said pin in said groove when said pivotal pieces are in said non-actuated position to block axial motion of said drive member.

3. A magnetically operable lock, as claimed in claim 2, wherein said guide groove is defined on said drive member and has first and second circumferentially extending, substantially parallel groove portions with an oblique groove portion interconnecting said first and second portions, one of said parallel groove portions being located axially closer to said latch than the other, said pin arried by said casing engaged in said groove so that when said pin is in said one of the groove portions which is closer to said latch or in said oblique groove portion, said latch can rotate.

4. A magnetically operable lock, as claimed in claim 2, wherein there are a plurality of magnetic pivotal pieces spaced around the inner end of said turnable member, said end face of said drive member having a plurality of magnetic piece receiving cavities into which associated ones of said pivotal magnetic pieces are engageable.

5. A magnetically operable lock, as claimed in claim 2, wherein said connecting means connecting said turnable member with said drive member includes a crosspin carried by said turnable member, said drive member having an axially elongated slot in which said crosspin extends permitting relative axial movement between said turnable member and said drive member.

6. A magnetically operable lock, as claimed in claim 2, wherein said connection means includes an axially extending pin, said drive member having an axially elongated receiving opening for said pin.

* * * * *